US010094311B1

(12) United States Patent
Lee

(10) Patent No.: US 10,094,311 B1
(45) Date of Patent: Oct. 9, 2018

(54) METHOD FOR CORRECTING AIR-FUEL RATIO DEVIATION FOR EACH CYLINDER IN ENGINE

(71) Applicants: Hyundai Motor Company, Seoul (KR); Kia Motors Corporation, Seoul (KR)

(72) Inventor: Dong-Hoon Lee, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/835,869

(22) Filed: Dec. 8, 2017

(30) Foreign Application Priority Data

Sep. 8, 2017 (KR) ..... 10-2017-0115168

(51) Int. Cl.
*F02D 41/00* (2006.01)
*F02D 41/14* (2006.01)

(52) U.S. Cl.
CPC ..... *F02D 41/0085* (2013.01); *F02D 41/1454* (2013.01); *F02D 41/1402* (2013.01); *F02D 2041/141* (2013.01); *F02D 2041/1416* (2013.01)

(58) Field of Classification Search
CPC ..... F02D 41/1441; F02D 41/1443; F02D 41/1445; F02D 41/1454; F02D 41/2441; F02D 41/2445
USPC ..... 123/673–675, 679; 701/103, 104, 109
See application file for complete search history.

(56) References Cited

U.S. PATENT DOCUMENTS 6,382,198 B1 5/2002 Smith et al.
2016/0061131 A1* 3/2016 Santillo ..... F02D 41/0295 60/274
2017/0089280 A1* 3/2017 Santillo ..... F01N 3/08
2017/0342926 A1* 11/2017 Sugihira ..... F02D 41/10

* cited by examiner

*Primary Examiner* — John Kwon
(74) *Attorney, Agent, or Firm* — Mintz Levin Cohn Ferris Glovsky and Popeo, P.C.; Peter F. Corless

(57) ABSTRACT

A method for correcting an air-fuel ratio deviation for each cylinder in an engine of a vehicle includes measuring a signal of an oxygen sensor mounted on an exhaust pipe of the vehicle using a low-pass filter and a moving-average filter; calculating an oxygen sensor roughness based on the measured signal of the oxygen sensor modulating a fuel injection amount of fuel injected into each cylinder in the engine; detecting a variation of the oxygen sensor roughness according to the modulated fuel injection amount; determining an optimal fuel injection amount based on a relationship between the fuel injection amount and the oxygen sensor roughness; performing fuel injection amount control based on the determined optimal fuel injection amount to correct the air-fuel ratio deviation for each cylinder.

16 Claims, 11 Drawing Sheets

METHOD FOR CORRECTING AIR-FUEL RATIO DEVIATION FOR EACH CYLINDER IN ENGINE

CROSS-REFERENCE TO RELATED APPLICATION

This application claims the benefit of priority to Korean Patent Application No. 10-2017-0115168, filed on Sep. 8, 2017, which is hereby incorporated by reference in its entirety as if fully set forth herein.

BACKGROUND OF THE DISCLOSURE

Technical Field

Embodiments of the present disclosure relate to a method for correcting an air-fuel ratio deviation for each cylinder in an engine and, more particularly, to a method for correcting an air-fuel ratio deviation for each cylinder in an engine, which is capable of correcting an air-fuel ratio deviation for each cylinder, wherein the air-fuel ratio deviation may occur due to a position of an oxygen sensor in the engine and a mixing characteristic of an exhaust manifold.

Description of Related Art

Generally, an engine of a vehicle is provided with an oxygen sensor at an exhaust pipe thereof, and air-fuel ratio feedback correction is performed to increase or decrease a fuel injection amount according to an output signal of the oxygen sensor. Through such a process, an exhaust air-fuel ratio is maintained around a theoretical air-fuel ratio such that a purification ratio of a three-way catalyst is increased, thus achieving exhaust purification.

In a multi-cylinder engine, when a deviation is present in the exhaust air-fuel ratio for each cylinder, even though an average exhaust air-fuel ratio of all cylinders is maintained to a theoretical air-fuel ratio, combustion takes place at each cylinder in a rich or lean state, and exhaust gas is discharged. When the exhaust gas is discharged in a rich state, a large amount of HC and CO pass through a three-way catalyst. When the exhaust gas is discharged in a lean state, a large amount of NOx passes through the three-way catalyst. Thus, the HC, the CO, and the NOx are not effectively purified.

In order to prevent such a problem, a deviation of an exhaust air-fuel ratio for each cylinder may be estimated on the basis of a measured value of an oxygen sensor, which is provided in front of a three-way catalyst, to correct a fuel injection amount. Conventionally, an oxygen sensor signal is processed by a high-pass filter, and then the processed oxygen sensor is used as a deviation index between cylinders. The deviation index is matched to a combustion time of each cylinder using the fact that exhaust gas combusted in each cylinder sequentially reacts with an oxygen sensor. A fuel amount of a corresponding cylinder is adjusted using the deviation index between cylinders.

Here, it is assumed that the exhaust gas combusted in each cylinder sequentially reacts with the oxygen sensor, and a time required for the exhaust gas to move to and react with the oxygen sensor should be used differently according to a driving condition of a vehicle. For example, since the time required for the exhaust gas to move to and react with the oxygen sensor is different according to an engine load and the number of revolutions of the engine, the time should differ according to the engine load and the number of revolutions.

In this method, however, the sensor detection timing of combustion gas of the engine is significantly influenced by the external environment, such as a hardware configuration of the exhaust manifold and a position of the oxygen sensor. Thus, it can be difficult to accurately measure the sensor detection timing. Further, it can be difficult account for the deviation between engines and vehicles which are mass produced.

SUMMARY OF THE DISCLOSURE

Embodiments of the present disclosure are directed to a method for correcting an air-fuel ratio deviation, which is capable of detecting an air-fuel ratio deviation for each cylinder with high reliability and reducing a calibration burden on a dynamic characteristic of exhaust gas under all driving conditions using a real-time optimization algorithm without considering a time required for the exhaust gas to react with an oxygen sensor.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with embodiments of the present disclosure, a method includes: measuring a signal of an oxygen sensor mounted on an exhaust pipe of the vehicle using a low-pass filter and a moving-average filter; calculating an oxygen sensor roughness based on the measured signal of the oxygen sensor modulating a fuel injection amount of fuel injected into each cylinder in the engine; detecting a variation of the oxygen sensor roughness according to the modulated fuel injection amount; determining an optimal fuel injection amount based on a relationship between the fuel injection amount and the oxygen sensor roughness; performing fuel injection amount control based on the determined optimal fuel injection amount to correct the air-fuel ratio deviation for each cylinder.

The calculating of the oxygen sensor roughness may include processing the measured signal of the oxygen sensor using a low-pass filter; after processing the measured signal of the oxygen sensor using the low-pass filter, processing the measured signal of the oxygen sensor using a moving-average filter; calculating a difference between the processed signal using the low-pass filter and the processed signal using the moving-average filter; determining a roughness signal for calculating the oxygen sensor roughness, wherein the roughness signal equals the calculated difference between the processed signal using the low-pass filter and the processed signal using the moving-average filter; determining a maximum value and a minimum value of the roughness signal throughout every period of an engine cycle; calculating a difference between the maximum value of the roughness signal and the minimum value of the roughness signal; and determining the oxygen sensor roughness, wherein the oxygen sensor roughness equals the calculated difference between the maximum value of the roughness signal and the minimum value of the roughness signal.

The determining of the optimal fuel injection amount may include sequentially modulating the fuel injection amounts calculating the oxygen sensor roughness with respect to each of the modulated fuel injection amounts; determining a fuel injection amount which minimizes the oxygen sensor roughness; and determining the optimal fuel injection amount, wherein the optimal fuel injection amount equals the fuel injection amount minimizing the oxygen sensor roughness.

The determining of the optimal fuel injection amount may include modulating an initial fuel injection amount by a predetermined fuel injection amount; after modulating the initial fuel injection amount, measuring an increase or a decrease of the oxygen sensor roughness; when the oxygen sensor roughness decreases, modulating the fuel injection amount in a direction equal to that of the decreasing oxygen sensor roughness; when the oxygen sensor roughness increases, modulating the fuel injection amount in a direction opposite to that of the increasing oxygen sensor roughness; and determining the fuel injection amount which minimizes the oxygen sensor roughness.

A modulated fuel amount subsequent to the initial fuel injection amount may be determined by a function of the variation of the oxygen sensor roughness.

When the variation of the oxygen sensor roughness is greater than a predetermined set value, the modulated fuel amount may increase, and when the variation of the oxygen sensor roughness is less than a predetermined set value, the modulated fuel amount may decrease.

When the variation of the oxygen sensor roughness is less than a predetermined set value, the fuel injection amount may be determined as an optimal fuel injection amount based on a variation of the modulated fuel amount.

When a state in which the variation of the oxygen sensor roughness is less than the predetermined set value is maintained for less than a predetermined number of times as the fuel injection amount is modulated, the fuel injection amount may be determined as the optimal fuel injection amount.

The determining of the optimal fuel injection amount may include modulating a plurality of fuel injection amounts; calculating a value of oxygen sensor roughness whenever each of the plurality of fuel injection amounts is modulated; determining a curve fitting coefficient from the calculated values of oxygen sensor roughness; performing a curve fitting with respect to the fuel injection amount and the oxygen sensor roughness; calculating the fuel injection amount which minimizes the oxygen sensor roughness using the curve fitting coefficient; and determining the optimal fuel injection amount, wherein the optimal fuel injection amount is equal to the fuel injection amount which minimizes the oxygen sensor roughness.

When the curve fitting coefficient is less than a predetermined value, the determining of the optimal fuel injection amount using the curve fitting may not be performed.

When the optimal fuel injection amount determined through the curve fitting deviates from the initial fuel injection amount outside of a predetermined range, the determining of the optimal fuel injection amount using the curve fitting may not be performed.

The method may further include modulating the fuel injection amount a predetermined number of times to determine the curve fitting coefficient; measuring the oxygen sensor roughness when the modulating of the fuel injection amount is performed; when an inflection point of the measured oxygen sensor roughness occurs within the predetermined number of times while the modulating of the fuel injection amount is performed, stopping the modulating of the fuel injection amount; and determining the optimum fuel injection amount based on the modulated fuel injection amount.

The method may further include, when the fuel injection amounts of a plurality of cylinders of the vehicle are sequentially modulated, the optimal fuel injection amount for each cylinder is determined, and determining of a final optimal fuel injection amount with respect to the plurality of cylinders is completed: performing the control of the fuel injection amount based on the final optimal fuel injection amount, and correcting the air-fuel ratio deviation for each cylinder.

The modulating of the fuel injection amount may be performed when a learning condition, in which an air-fuel ratio of an exhaust system is modulated by only a fuel amount, is satisfied.

The method may include, when a current oxygen sensor roughness value is less than a predetermined value, a learning condition for performing an optimal fuel injection amount learning may not be satisfied.

The method may further include storing the optimal fuel injection amount in a nonvolatile memory of the vehicle; and using the stored optimal fuel injection amount at a next learning time for determining the optimal fuel injection amount.

BRIEF DESCRIPTION OF THE DRAWINGS

The embodiments herein may be better understood by referring to the following description in conjunction with the accompanying drawings, briefly described below, in which like reference numerals indicate identically or functionally similar elements.

Figure 1:
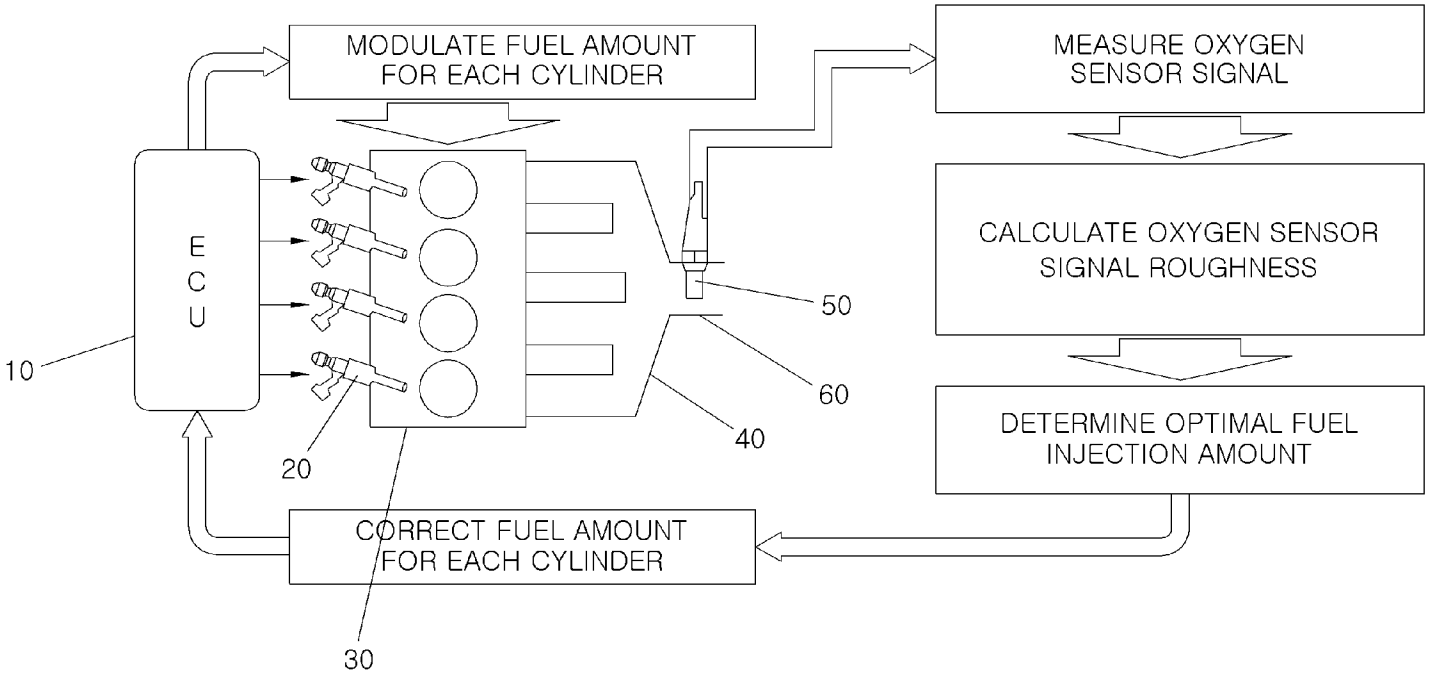
FIG. 1 is a diagram illustrating a method for correcting an air-fuel ratio deviation for each cylinder in an engine according to embodiments of the present disclosure, and a main configuration of the engine related to the method.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, preferred embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Additionally, it is understood that one or more of the below methods, or aspects thereof, may be executed by at least one control unit. The term "control unit" may refer to a hardware device that includes a memory and a processor. The memory is configured to store program instructions, and the processor is specifically programmed to execute the program instructions to perform one or more processes which are described further below. Moreover, it is understood that the below methods may be executed by an apparatus comprising the control unit in conjunction with one or more other components, as would be appreciated by a person of ordinary skill in the art.

Figure 11:
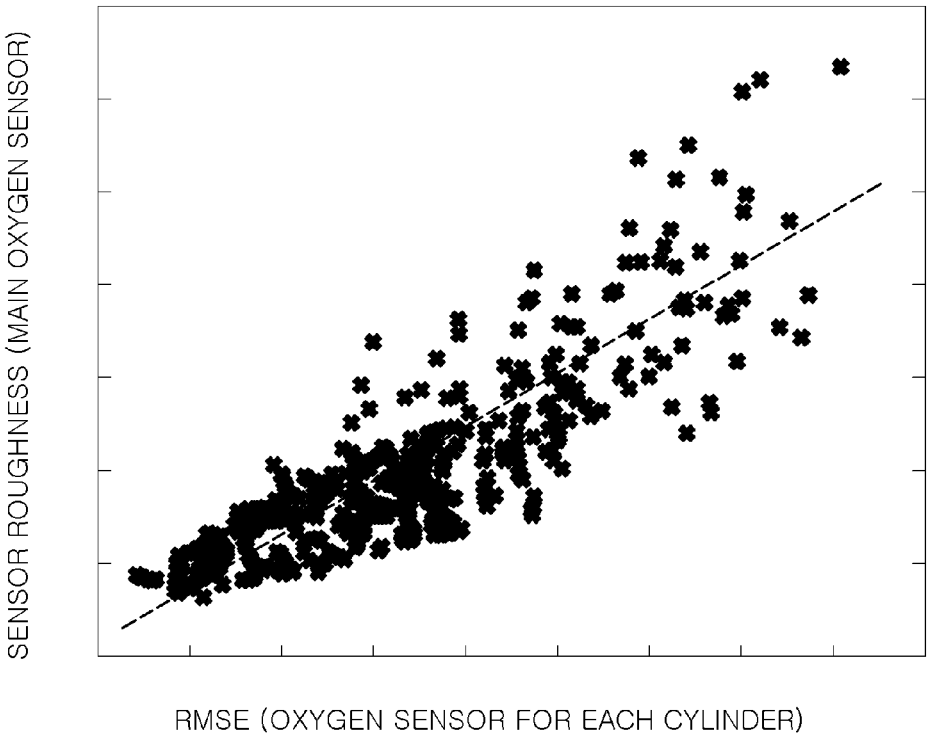
FIG. 11 is a graph illustrating a deviation relationship between the oxygen sensor roughness and a detected value of the oxygen sensor for each cylinder.

Referring now to the presently disclosed embodiments, there is a correlation between the air-fuel ratio deviation for each cylinder and oxygen sensor roughness. The correlation between the air-fuel ratio deviation for each cylinder and the oxygen sensor roughness is shown in FIG. 11.

In a graph of FIG. 11, an X-axis represents a root mean square error (RMSE) of measured values of the oxygen sensor of each cylinder, and a Y-axis represents an oxygen sensor roughness value, which will be described below with reference to preferred embodiments of the present disclosure, obtained through a signal process of the oxygen sensor. As shown in FIG. 11, as the oxygen sensor roughness value is small, a deviation of the oxygen sensor of each cylinder is small, and, as the oxygen sensor roughness value is large, the deviation of the oxygen sensor of each cylinder is large. Consequently, when a fuel injection amount value minimizing the oxygen sensor roughness value can be obtained, control of the air-fuel ratio may be performed using the obtained fuel injection amount to minimize the deviation of the oxygen sensor of each cylinder.

The fuel injection amount is intentionally modulated and, at that time, a variation of an oxygen sensor roughness value is observed, and thus a fuel injection amount minimizing the oxygen sensor roughness value is determined such that control of an air-fuel ratio is performed to minimize a deviation of an oxygen sensor of each cylinder.

FIG. 1 is a diagram illustrating a method for correcting an air-fuel ratio deviation for each cylinder in an engine according to embodiments of the present disclosure, and a main configuration of the engine related to the method.

Figure 2:
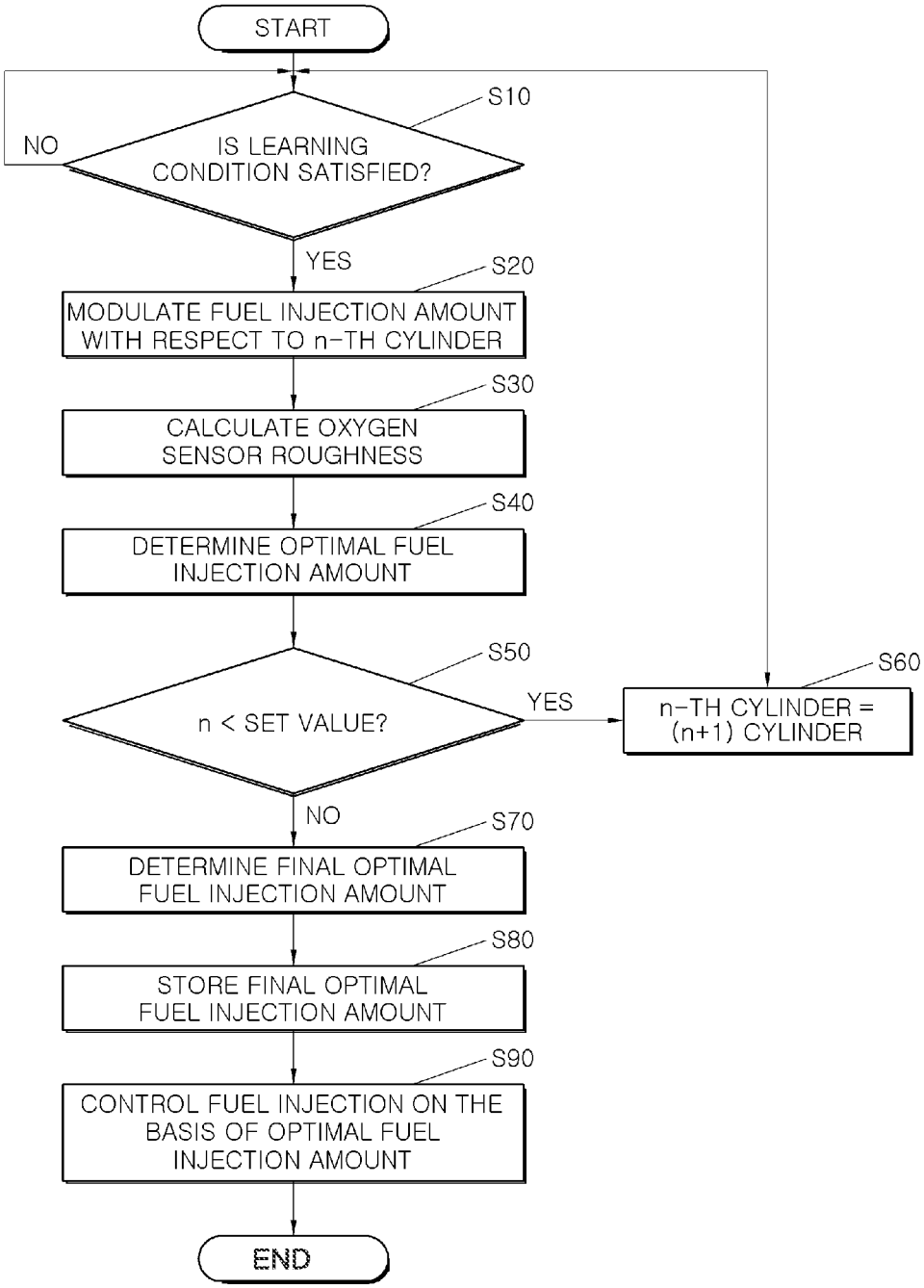
FIG. 2 is a flowchart illustrating the method for correcting an air-fuel ratio deviation for each cylinder in an engine according to embodiments of the present disclosure.

Here, an electronic control unit (ECU) 10 is a main body that performs the method for correcting an air-fuel ratio deviation for each cylinder shown in FIGS. 1 and 2. The ECU 10 controls an injector 20 to modulate a fuel injection amount, and performs control of correcting an air-fuel ratio deviation for each cylinder by receiving a measured signal from an oxygen sensor 50 installed at an exhaust pipe 60, determining an optimal fuel injection amount capable of minimizing an air-fuel ratio deviation for each cylinder, and controlling the injector 20 on the basis of the determined optimal fuel injection amount. More specifically, the ECU 10 controls the injector 20 to modulate a fuel amount supplied to each cylinder.

The injector 20 supplies fuel corresponding to the fuel amount modulated by the ECU 10 to each cylinder 30 of the engine, and the supplied fuel is combusted inside each cylinder 30 and is discharged to the outside of each cylinder 30 as exhaust gas. The exhaust gas discharged from each cylinder 30 is collected into the single exhaust pipe 60 through an exhaust collecting pipe 40 extending from an exhaust outlet of each cylinder 30 to be discharged to the outside of a vehicle. The oxygen sensor 50 mounted on the exhaust pipe 60 measures an oxygen ratio in the exhaust gas and transmits the measurement result to the ECU 10 as a signal in a predetermined form.

Meanwhile, the ECU 10 processes the measured signal transmitted from the oxygen sensor 50 installed at the exhaust pipe 60 by a low-pass filter and a moving-average filter to calculate oxygen sensor roughness.

Figure 3:
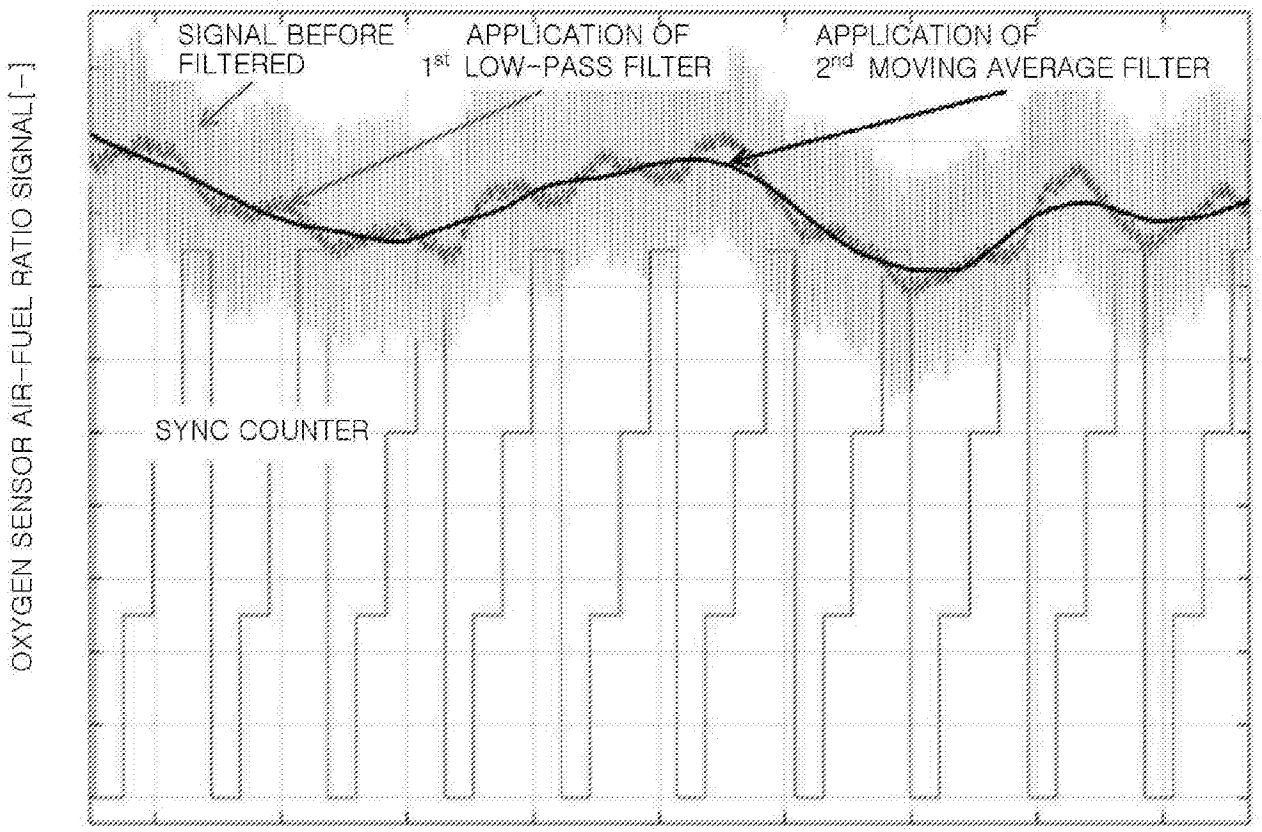
FIG. 3 is a signal diagram illustrating an oxygen sensor signal, a signal obtained by primarily filtering the oxygen sensor signal by a low-pass filter, and a signal obtained by secondarily filtering the primarily filtered signal by a moving-average filter.

FIG. 3 illustrates the measured signal (i.e., a signal before filtered) from the oxygen sensor 50, a primarily processed signal that is obtained by processing the measured signal by the low-pass filter, and a secondarily processed signal that is obtained by processing the primarily processed signal by the moving-average filter.

Figure 4:
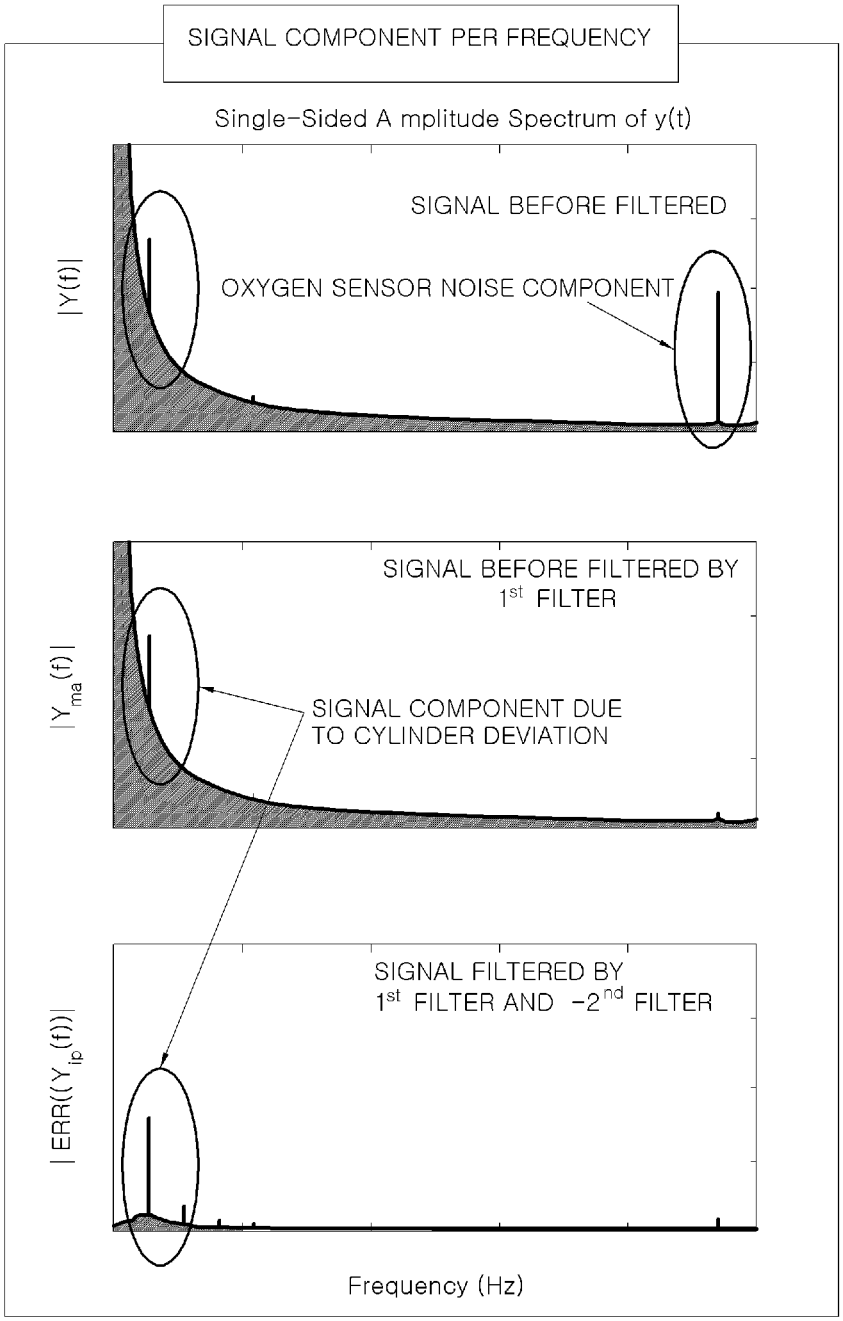
FIG. 4 is a diagram for describing a process of removing a noise component of an oxygen sensor by the primary filtering and the secondary filtering, and obtaining a signal component due to a cylinder deviation.
Figure 5:
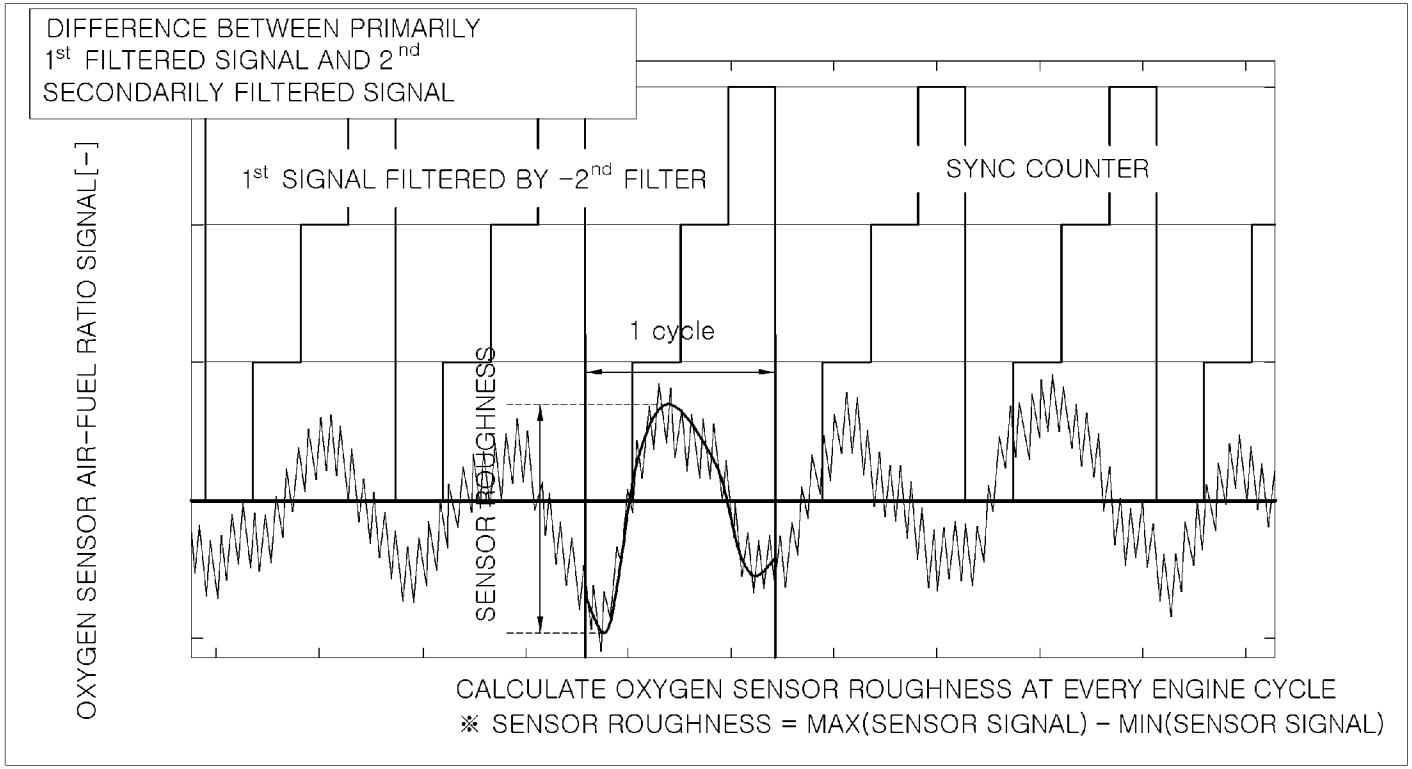
FIG. 5 is a diagram for describing a process of detecting oxygen sensor roughness within one cycle on the basis of the primarily filtered signal and the secondarily filtered signal.

As shown in FIG. 4, when the measured signal is primarily processed by the low-pass filter, noise component of the oxygen sensor 50 is removed. Also, when the primarily processed signal is secondarily processed by the moving-average filter, a representative value of an average air-fuel ratio for each cylinder is calculated. Further, when a component of the secondarily processed signal is removed from a component of the primarily processed signal component, only a signal component due to a cylinder deviation is obtained. The obtained signal component becomes an oxygen sensor air-fuel ratio signal shown in FIG. 5.

Next, during a corresponding cycle, when a difference value between a minimum value and a maximum value of a component of the oxygen sensor air-fuel ratio signal is obtained, the difference value becomes the oxygen sensor roughness. As described above with reference to FIG. 11, the oxygen sensor roughness has correlation proportional to the air-fuel ratio deviation for each cylinder.

Therefore, the ECU 10 may determine an optimal fuel injection amount minimizing the oxygen sensor roughness from a variation of the oxygen sensor roughness according to a fuel amount modulation for each cylinder.

Figure 6:
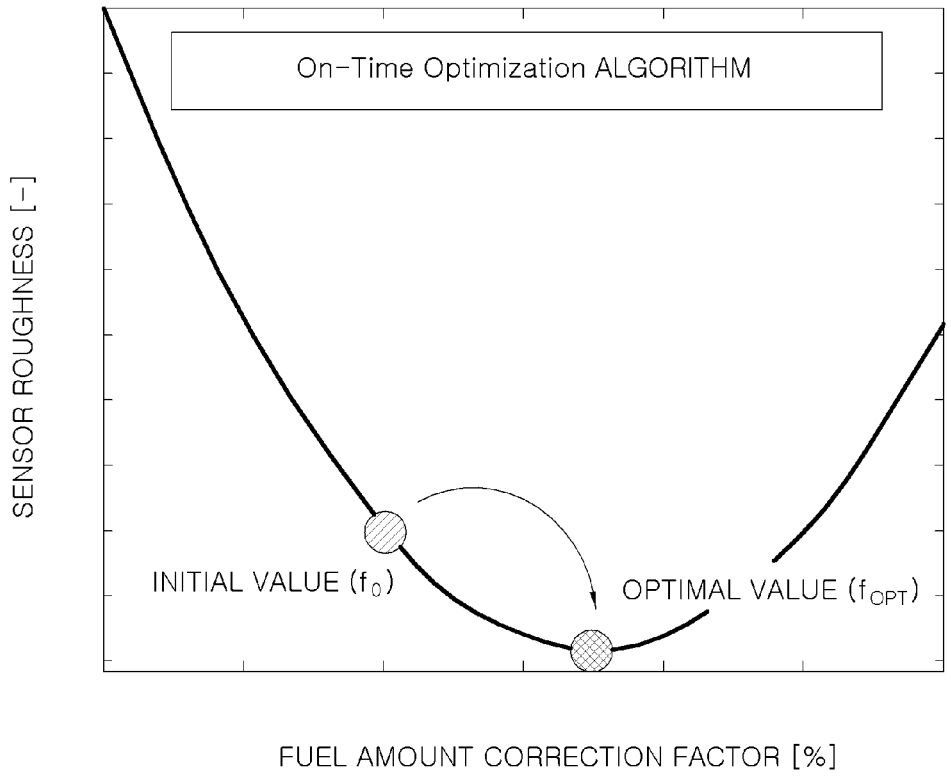
FIG. 6 is a diagram illustrating a process of detecting a minimum value of the oxygen sensor roughness through a fuel amount modulation.

More specifically, as shown in FIG. 6, a variation of an oxygen sensor roughness value according to a degree of the fuel amount modulation (i.e., a fuel amount correction factor) when the fuel amount is modulated is detected, thereby obtaining the fuel amount correction factor minimizing the oxygen sensor roughness. As described above, since the oxygen sensor roughness has the correlation proportional to the air-fuel ratio deviation for each cylinder, when the oxygen sensor roughness is minimized, the air-fuel ratio deviation for each cylinder is also minimized. Consequently, when the fuel amount correction factor minimizing the oxygen sensor roughness is obtained to determine an optimal fuel injection amount, the optimal fuel injection amount becomes a fuel injection amount that is capable of minimizing the air-fuel ratio deviation for each cylinder.

Meanwhile, two optimization methods may be applied as a method for determining an optimal fuel injection amount.

Figure 7:
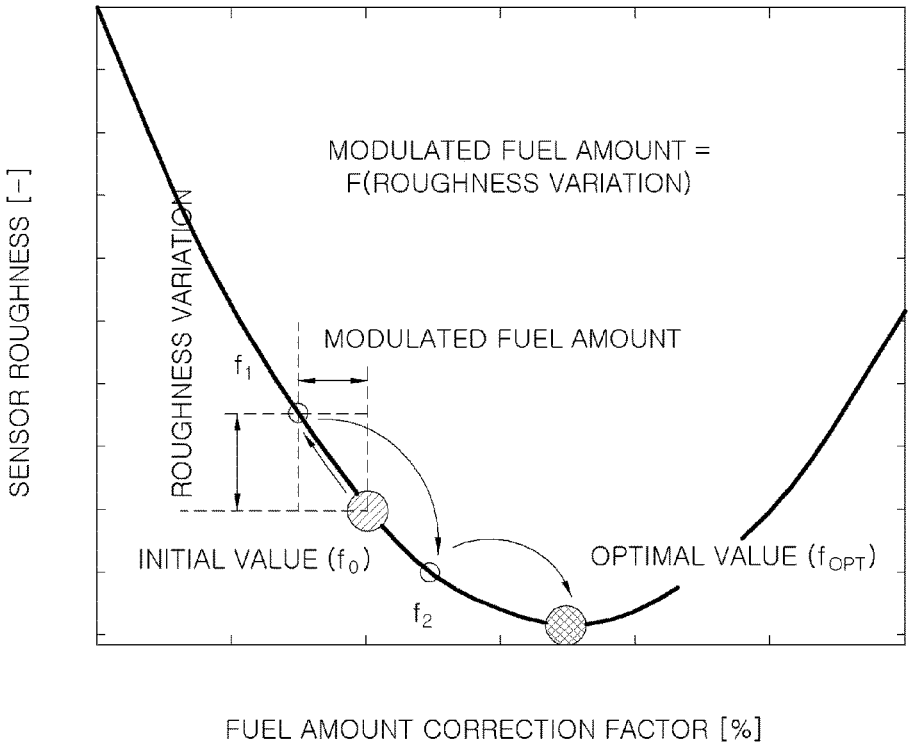
FIG. 7 is a diagram illustrating an extreme-seeking algorithm among methods of detecting a minimum value of oxygen sensor roughness through a fuel amount modulation.

First, an optimal fuel injection amount may be determined using an extreme-seeking algorithm. FIG. 7 is a diagram illustrating an extreme-seeking algorithm among methods of detecting a minimum value of oxygen sensor roughness through a fuel amount modulation.

To this end, a fuel injection amount is first modulated from an initial fuel amount by a predetermined fuel modulation amount and then an increase or a decrease of oxygen sensor roughness is determined at a time when the fuel injection amount is modulated. At this point, when a detected value $f_2$ of the oxygen sensor roughness decreases from an initial value $f_0$, a fuel modulation is gradually performed in a direction the same as that of the decrease, and, when a detected value at a point $f_1$ of the oxygen sensor roughness increases, the fuel modulation is performed in a direction opposite to that of the increase.

Since a variation of the oxygen sensor roughness is reduced around the optimal fuel injection amount, when the variation of the oxygen sensor roughness is less than a predetermined reference, a value $f_{OPT}$ may be determined as an optimum point using the above-described characteristic.

Further, a modulated amount when a fuel modulation is performed subsequent to the first fuel modulation may be determined by a function of the variation of the oxygen sensor roughness. For example, when the variation of the oxygen sensor roughness is large, that is, when the oxygen sensor roughness is far away from the optimal fuel amount, a modulated fuel amount is set to be large, and, when the variation of the oxygen sensor roughness is small, that is, when the oxygen sensor roughness is close to the optimal fuel amount, the modulated fuel amount is set to be small.

Consequently, a rapid convergence to the optimal point can be achieved and an accurate optimal point determination can be performed. Further, when the variation of the oxygen sensor roughness is maintained below a predetermined level and for less than a predetermined number of times when the fuel modulation is performed, a fuel injection amount at a corresponding position (i.e., an optimal point) is determined as an optimal fuel injection amount.

Next, the optimal fuel injection amount may be determined using a cuff fitting method.

Figure 8:
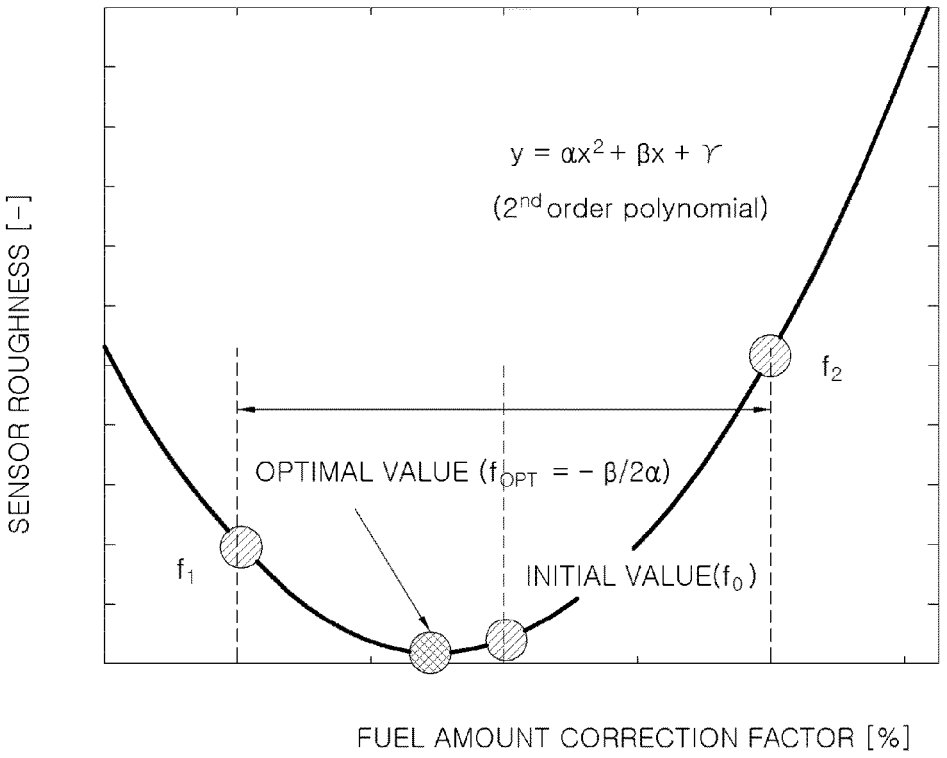
FIG. 8 is a diagram illustrating a second-order polynomial curve fitting algorithm among the methods of detecting a minimum value of oxygen sensor roughness through a fuel amount modulation.

FIG. 8 is a diagram illustrating a second-order polynomial curve fitting algorithm among the methods of detecting a minimum value of oxygen sensor roughness through a fuel amount modulation.

The curve fitting algorithm shown in FIG. 8 requires a precondition that a relationship of the oxygen sensor roughness to a fuel correction has a form similar to a second-order polynomial equation as shown in FIG. 8.

In order to derive the second-order polynomial equation, three coefficients $\alpha$, $\beta$, and $\gamma$ should be determined, and an initial fuel amount modulation are required three or more times to determine the three coefficients $\alpha$, $\beta$, and $\gamma$.

The ECU 10 obtains three oxygen sensor roughness values at points $f_0$, $f_1$, and $f_2$ through the initial fuel amount modulation three times to determine the three coefficients $\alpha$, $\beta$, and $\gamma$ of the second-order polynomial equation from the three oxygen sensor roughness values at the points $f_0$, $f_1$, and $f_2$. Further, when the second-order polynomial equation is determined, a fuel amount correction factor minimizing the oxygen sensor roughness may be determined from the second-order polynomial equation, and an optimal fuel injection amount may be determined from the fuel amount correction factor.

Meanwhile, when the three coefficients $\alpha$, $\beta$, and $\gamma$ of the second-order polynomial equation is less than a given reference since the variation of the oxygen sensor roughness is very small when the fuel modulation is performed, it is difficult to satisfy the precondition that the relationship of the oxygen sensor roughness to the fuel correction has a form similar to the second-order polynomial equation, so that the optimum fuel injection amount may not be determined in this algorithm. Therefore, in this case, instead of determining the optimal fuel injection amount through the cuff fitting algorithm, determining of the optimal fuel injection amount is performed using the above-described extreme-seeking algorithm.

Also, even when the optimal fuel injection amount determined through the curve fitting algorithm deviates from the initial fuel injection amount over a predetermined range, reliability in determination of the optimal fuel injection amount according to the curve fitting algorithm is determined to be degraded, so that, instead of determining the optimal fuel injection amount through the curve fitting algorithm, determining of the optimal fuel injection amount is performed using the above-described extreme-seeking algorithm.

Meanwhile, a characteristic of sensing exhaust gas at the oxygen sensor may be different from each cylinder according to a shape of an exhaust system by a kind of vehicle and an installation position of the oxygen sensor. In this case, a relationship between the fuel injection amount and the oxygen sensor roughness value is different from a form of the second-order polynomial equation. Accordingly, it is difficult to determine an optimal point by evaluating only the oxygen sensor roughness through the fuel amount modulation three times. Therefore, in this case, in order to determine the relationship between the fuel injection amount and the oxygen sensor roughness value, the evaluation should be performed a plurality of times in a direction in which a fuel amount is increased or decreased on the basis of a current fuel injection amount.

Figure 9:
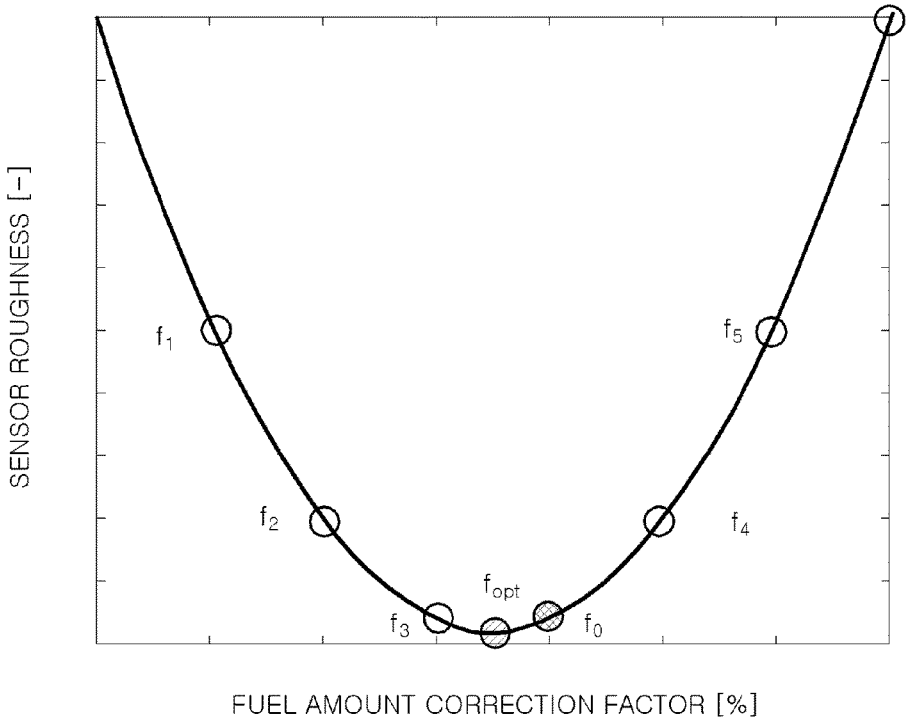
FIG. 9 is a diagram illustrating a parabolic-search algorithm among the methods of detecting a minimum value of oxygen sensor roughness through a fuel amount modulation.

In this case, however, when a parabolic-search algorithm performed as in FIG. 9 is applied to the above-described case, the number of times the fuel amount modulation is performed can be reduced. In this parabolic-search algorithm, the fuel amount is modulated a given number of times from a point $f_1$ to a point $f_6$ to evaluate the oxygen sensor roughness, and, when an inflection point $f_{OPT}$ indicating the optimal point occurs during evaluation, the evaluation may be stopped to reduce the number of times of the evaluation. For example, in an example shown in FIG. 9, the fuel amount modulation and the oxygen sensor roughness are evaluated in the order of the points $f_1$ to $f_6$, and, since an inflection point is determined between the points $f_3$ and $f_4$ when the evaluation is performed at the point $f_4$, the evaluation is stopped and an optimum point is determined on the basis of the evaluation results from the point $f_1$ to the point $f_4$.

When the optimal fuel injection amount is determined through such a parabolic-search algorithm, the ECU 10 corrects the fuel amount for each cylinder on the basis of the determined optimum fuel injection amount to correct the air-fuel ratio deviation for each cylinder.

As described above, in the method for correcting an air-fuel ratio deviation for each cylinder according to embodiments of the present disclosure, an optimum signal for all the cylinders is controlled without determining and measuring the air-fuel ratio of each cylinder such that a deviation for each cylinder is reduced. Therefore, irrespective of the shape of the exhaust system by a kind of vehicle and a difference in installation position of the oxygen sensor, correction of the air-fuel ratio deviation for each cylinder can be possible with relative reliability.

Hereinafter, the method for correcting an air-fuel ratio deviation for each cylinder, which is performed by the ECU 10, will be described in detail with reference to FIG. 2.

FIG. 2 is a flowchart illustrating the method for correcting an air-fuel ratio deviation for each cylinder in an engine according to the present disclosure of FIG. 1.

As shown in FIG. 2, the ECU 10 first determines whether a learning condition is satisfied to perform the method for correcting an air-fuel ratio deviation for each cylinder in an engine according to embodiments of the present disclosure (S10).

As described above, the correction method according to embodiments of the present disclosure should satisfy a condition in which the correction method is performed only when the engine operates and an air-fuel ratio of the exhaust system should be varied by only a fuel amount modulation. Therefore, the ECU 10 first determines whether the above-described condition is satisfied before performing the method for correcting an air-fuel ratio deviation for each cylinder.

To this end, the ECU 10 determines whether to perform the correction method with reference to whether an oxygen sensor signal is activated, whether an air-fuel ratio feedback is possible, whether incomplete combustion occurs, a load and a speed of an engine, external environment such as an outside air temperature and atmospheric pressure, a temperature of engine cooling water, a state of a fuel purge valve, an elapsed time after ignition, and the like.

Meanwhile, when the method for correcting an air-fuel ratio deviation is frequently performed, there is a concern in which the fuel injection amount modulation consumes a large amount of fuel and driving ability of a vehicle is degraded. Therefore, an oxygen sensor roughness value, which will be described below, may also be considered as one of the learning conditions.

More specifically, in order to minimize an adverse effect on fuel efficiency and driving ability, when the oxygen sensor roughness value, which will be described below, is less than a predetermined value, the ECU 10 may determine that a need for performing the method for correcting an air-fuel ratio deviation for each cylinder is low, thereby stopping the performing of the method for correcting an air-fuel ratio deviation for each cylinder.

When the learning condition is determined to be satisfied, the ECU 10 controls the injector 20 to modulate a fuel injection amount with respect to a first cylinder among a plurality of cylinders (S20). When the fuel injection amount is modulated, an air-fuel ratio is varied and thus an oxygen concentration in exhaust gas flowing to the exhaust pipe 60 is also varied. The ECU 10 receives a measured signal related to the oxygen concentration in the exhaust gas using the oxygen sensor 50 installed at the exhaust pipe 60, and filters the measured signal to calculate oxygen sensor roughness (S30).

Next, the ECU 10 applies the above-described extreme-seeking algorithm or curve fitting algorithm to the calculated oxygen sensor roughness, thereby determining an optimal fuel injection amount (S40).

When the optimal fuel injection amount is determined, the ECU 10 determines whether the optimization control is performed for all cylinders. The optimization control according to embodiments of the present disclosure is sequentially performed in the order of the cylinders, and is performed for all the cylinders. That is, the ECU 10 determines whether an n-th cylinder on which the optimization control is currently performed is a last cylinder (S50).

As the determination result, when a cylinder on which the optimization control is not yet performed is present, the ECU 10 performs the modulating of the fuel amount (S20), the calculating of the oxygen sensor roughness (S30), and the determining of the optimum fuel amount (S40) with respect to the corresponding cylinder.

After the optimization control is performed for all the cylinders, a final optimal fuel injection amount for each of the cylinders is determined (S70). The ECU 10 stores the final optimal fuel injection amount for each of the cylinders in a nonvolatile memory inside or outside the ECU 10 (S80). Further, the ECU 10 performs fuel injection control with respect to each cylinder on the bases of the final optimal fuel injection amount (S90). Meanwhile, the stored final optimal fuel injection amount is used for the fuel injection control until a next learning time.

Figure 10:
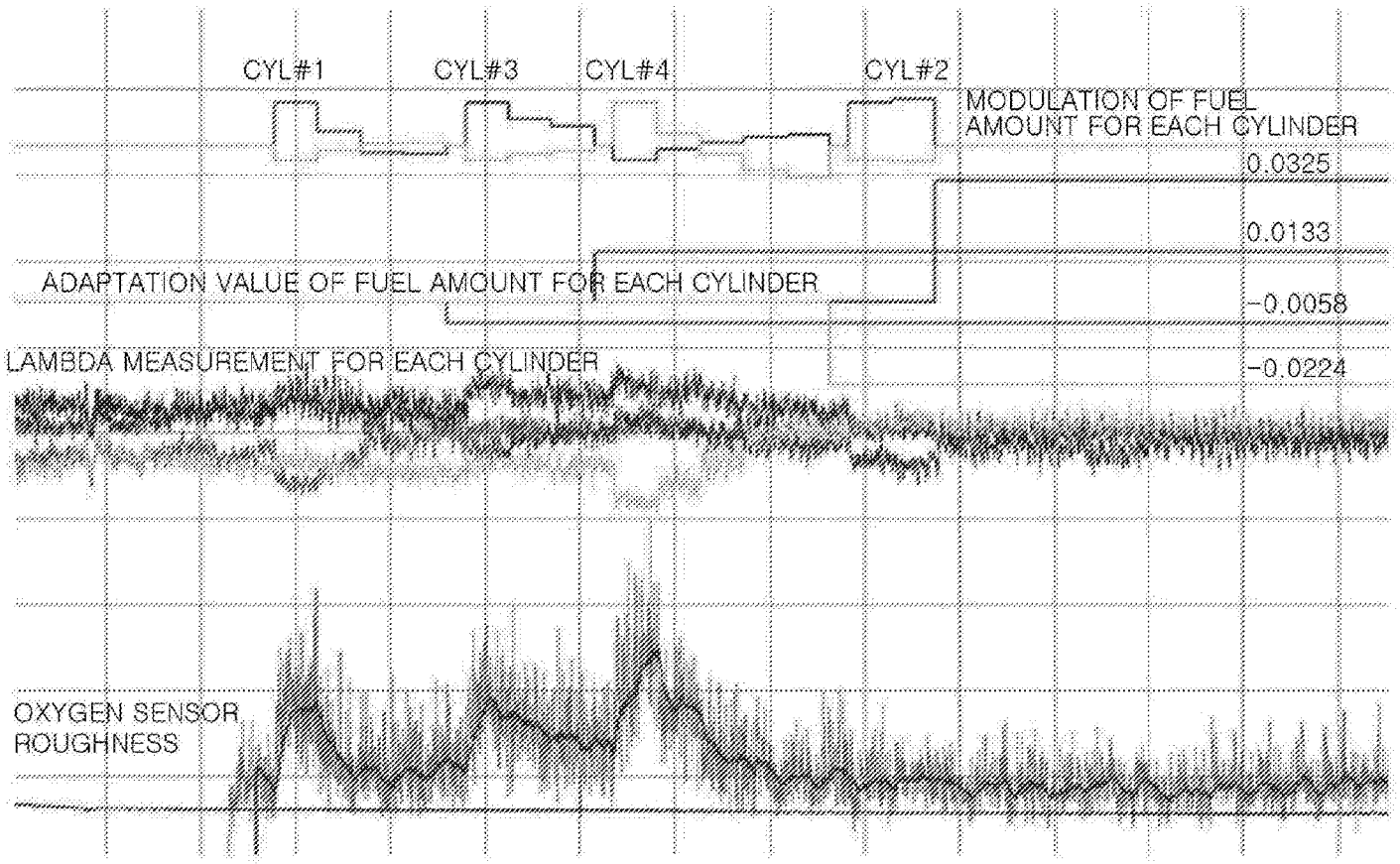
FIG. 10 is a signal diagram illustrating variations of a measured oxygen sensor signal and oxygen signal roughness of a fuel amount for each cylinder when the method for correcting an air-fuel ratio deviation for each cylinder according to embodiments of the present disclosure is performed.

FIG. 10 illustrates variations of a measured oxygen sensor signal and oxygen signal roughness of a fuel amount for each cylinder when the method for correcting an air-fuel ratio deviation for each cylinder according to the present disclosure is performed.

As shown in FIG. 10, through the ECU 10, the fuel amount for each cylinder is modulated, and the optimal fuel amount correction value capable of minimizing the oxygen sensor roughness is determined at a time when the fuel amount for each cylinder is modulated. When the optimal fuel amount correction value for each cylinder is finally determined, the optimal fuel injection amount is determined on the basis of the corresponding optimal fuel amount correction value, and the fuel supply control is performed for each cylinder.

As described above, according to embodiments of the present disclosure, the fuel injection amount for each cylinder is modulated, and then a measured signal of a single main oxygen sensor is processed to enable optimal control of an air-fuel ratio to be performed for all the cylinders. Consequently, there is no need to measure the air-fuel ratio for each cylinder so as to correct the air-fuel ratio deviation for each cylinder, and, to this end, there is no need to find out a method for distinguishing the cylinders from one another.

Therefore, irrespective of the difference in shape of the exhaust system by a kind of vehicle or the difference in installation position of the oxygen sensor, correction of the air-fuel ratio for each cylinder can be possible with relative reliability such that a control method can be continuously applied to when various kind of vehicle is developed.

In accordance with the disclosed method of correcting an air-fuel ratio deviation for each cylinder in an engine according to embodiments of the present disclosure, a deviation for each cylinder is reduced by controlling an optimal signal with respect to all cylinders without determining and measuring an air-fuel ratio for each cylinder such that correction of an air-fuel ratio deviation can be possible with relative reliability irrespective of a difference in shape of an exhaust system or in installation position of an oxygen sensor according to a kind of vehicle.

Accordingly, the method of correcting an air-fuel ratio deviation for each cylinder according to embodiments of the present disclosure can be continuously applied to when various kind of vehicle is developed.

Further, in accordance with embodiments of the present disclosure, the air-fuel ratio deviation between the cylinders can be effectively reduced to improve fuel efficiency.

Furthermore, in accordance with embodiments of the present disclosure, combustion stability can be increased when the air-fuel ratio deviation for each cylinder is reduced and thus a lean margin of a fuel amount can be secured such that there is an effect of reducing exhaust gas.

In addition, in accordance with embodiments of the present disclosure, idle noise and vibration (NVH) caused by the air-fuel ratio deviation can be effectively improved, and torque efficiency of the engine can be increased such that driving stability can be improved.

Additionally, in accordance with embodiments of the present disclosure, since there is no need to differently set a reaction time of the oxygen sensor according to a driving condition in order to detect the air-fuel ratio deviation as in the prior art, a burden on an engine calibration can be reduced when a real-time air-fuel ratio correction logic is applied.

While the present disclosure has been described with respect to certain embodiments, it will be apparent to those skilled in the art that various changes and modifications may be made without departing from the spirit and scope of the disclosure as defined in the following claims.

What is claimed is:

1. A method for correcting an air-fuel ratio deviation for each cylinder in an engine of a vehicle, the method comprising:

measuring a signal of an oxygen sensor mounted on an exhaust pipe of the vehicle using a low-pass filter and a moving-average filter;

calculating an oxygen sensor roughness based on the measured signal of the oxygen sensor modulating a fuel injection amount of fuel injected into each cylinder in the engine;

detecting a variation of the oxygen sensor roughness according to the modulated fuel injection amount;

determining an optimal fuel injection amount based on a relationship between the fuel injection amount and the oxygen sensor roughness;

performing fuel injection amount control based on the determined optimal fuel injection amount to correct the air-fuel ratio deviation for each cylinder.

2. The method of claim 1, wherein the calculating of the oxygen sensor roughness comprises:

processing the measured signal of the oxygen sensor using a low-pass filter;

after processing the measured signal of the oxygen sensor using the low-pass filter, processing the measured signal of the oxygen sensor using a moving-average filter;

calculating a difference between the processed signal using the low-pass filter and the processed signal using the moving-average filter;

determining a roughness signal for calculating the oxygen sensor roughness, wherein the roughness signal equals the calculated difference between the processed signal using the low-pass filter and the processed signal using the moving-average filter;

determining a maximum value and a minimum value of the roughness signal throughout every period of an engine cycle;

calculating a difference between the maximum value of the roughness signal and the minimum value of the roughness signal; and determining the oxygen sensor roughness, wherein the oxygen sensor roughness equals the calculated difference between the maximum value of the roughness signal and the minimum value of the roughness signal.

3. The method of claim 1, wherein the determining of the optimal fuel injection comprises:

sequentially modulating the fuel injection amounts calculating the oxygen sensor roughness with respect to each of the modulated fuel injection amounts;

determining a fuel injection amount which minimizes the oxygen sensor roughness; and determining the optimal fuel injection amount, wherein the optimal fuel injection amount equals the fuel injection amount minimizing the oxygen sensor roughness.

4. The method of claim 3, wherein the determining of the optimal fuel injection further comprises:

modulating an initial fuel injection amount by a predetermined fuel injection amount;

after modulating the initial fuel injection amount, measuring an increase or a decrease of the oxygen sensor roughness;

when the oxygen sensor roughness decreases, modulating the fuel injection amount in a direction equal to that of the decreasing oxygen sensor roughness;

when the oxygen sensor roughness increases, modulating the fuel injection amount in a direction opposite to that of the increasing oxygen sensor roughness; and determining the fuel injection amount which minimizes the oxygen sensor roughness.

5. The method of claim 4, wherein a modulated fuel amount subsequent to the initial fuel injection amount is determined by a function of the variation of the oxygen sensor roughness.

6. The method of claim 5, wherein:

when the variation of the oxygen sensor roughness is greater than a predetermined set value, the modulated fuel amount increases, and when the variation of the oxygen sensor roughness is less than a predetermined set value, the modulated fuel amount decreases.

7. The method of claim 4, wherein, when the variation of the oxygen sensor roughness is less than a predetermined set value, the fuel injection amount is determined as an optimal fuel injection amount based on a variation of the modulated fuel amount.

8. The method of claim 7, wherein, when a state in which the variation of the oxygen sensor roughness is less than the predetermined set value is maintained for less than a predetermined number of times as the fuel injection amount is modulated, the fuel injection amount is determined as the optimal fuel injection amount.

9. The method of claim 3, wherein the determining of the optimal fuel injection further comprises:

modulating a plurality of fuel injection amounts;

calculating a value of oxygen sensor roughness whenever each of the plurality of fuel injection amounts is modulated;

determining a curve fitting coefficient from the calculated values of oxygen sensor roughness;

performing a curve fitting with respect to the fuel injection amount and the oxygen sensor roughness;

calculating the fuel injection amount which minimizes the oxygen sensor roughness using the curve fitting coefficient; and determining the optimal fuel injection amount, wherein the optimal fuel injection amount is equal to the fuel injection amount which minimizes the oxygen sensor roughness.

10. The method of claim 9, wherein, when the curve fitting coefficient is less than a predetermined value, the determining of the optimal fuel injection amount using the curve fitting is not performed.

11. The method of claim 9, wherein, when the optimal fuel injection amount determined through the curve fitting deviates from the initial fuel injection amount outside of a predetermined range, the determining of the optimal fuel injection amount using the curve fitting is not performed.

12. The method of claim 9, further comprising:

modulating the fuel injection amount a predetermined number of times to determine the curve fitting coefficient;

measuring the oxygen sensor roughness when the modulating of the fuel injection amount is performed;

when an inflection point of the measured oxygen sensor roughness occurs within the predetermined number of times while the modulating of the fuel injection amount is performed, stopping the modulating of the fuel injection amount; and determining the optimum fuel injection amount based on the modulated fuel injection amount.

13. The method of claim 1, further comprising, when the fuel injection amounts of a plurality of cylinders of the vehicle are sequentially modulated, the optimal fuel injection amount for each cylinder is determined, and determining of a final optimal fuel injection amount with respect to the plurality of cylinders is completed:

performing the control of the fuel injection amount based on the final optimal fuel injection amount; and correcting the air-fuel ratio deviation for each cylinder.

14. The method of claim 1, wherein the modulating of the fuel injection amount is performed when a learning condition, in which an air-fuel ratio of an exhaust system is modulated by only a fuel amount, is satisfied.

15. The method of claim 13, wherein, when a current oxygen sensor roughness value is less than a predetermined value, a learning condition for performing an optimal fuel injection amount learning is not satisfied.

16. The method of claim 1, further comprising, when the optimal fuel injection amount is determined:

storing the optimal fuel injection amount in a nonvolatile memory of the vehicle; and using the stored optimal fuel injection amount at a next learning time for determining the optimal fuel injection amount.

* * * * *